US007677316B2

(12) United States Patent
Butler et al.

(10) Patent No.: US 7,677,316 B2
(45) Date of Patent: Mar. 16, 2010

(54) LOCALIZED FRACTURING SYSTEM AND METHOD

(75) Inventors: Tom Butler, Enumclaw, WA (US); Daniel Alberts, Maple Valley, WA (US); Jeff Honekamp, Tomball, TX (US); Martin Craighead, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 237 days.

(21) Appl. No.: 11/322,776

(22) Filed: Dec. 30, 2005

(65) Prior Publication Data

US 2007/0151731 A1 Jul. 5, 2007

(51) Int. Cl.
*E21B 43/26* (2006.01)
*E21B 7/08* (2006.01)
*E21B 7/04* (2006.01)

(52) U.S. Cl. ..... 166/308.1; 175/67; 166/222; 166/177.5

(58) Field of Classification Search ..... 166/297, 166/298, 308.1, 177.5, 222, 223; 175/67, 175/61, 62, 77, 78; 417/423.3
See application file for complete search history.

(56) References Cited

U.S. PATENT DOCUMENTS

| | | | | |
|---|---|---|---|---|
| 2,397,070 A | | 3/1946 | Zublin | |
| 2,778,603 A | | 1/1957 | McCune et al. | |
| 2,927,638 A | * | 3/1960 | Hall, Sr. | 166/297 |
| 3,640,344 A | | 2/1972 | Brandon | |
| 3,841,559 A | * | 10/1974 | Hall et al. | 239/101 |
| 3,892,274 A | * | 7/1975 | Dill | 166/222 |
| 3,933,205 A | * | 1/1976 | Kiel | 166/308.1 |
| 3,939,927 A | * | 2/1976 | Bohn | 175/4.52 |
| 3,958,649 A | | 5/1976 | Bull et al. | |
| 4,047,581 A | | 9/1977 | Erickson | |
| 4,119,160 A | | 10/1978 | Summers et al. | |
| 4,226,288 A | | 10/1980 | Collins, Jr. | |
| 4,306,627 A | | 12/1981 | Cheung et al. | |
| 4,317,492 A | | 3/1982 | Summers et al. | |
| 4,369,850 A | | 1/1983 | Barker | |
| 4,458,766 A | * | 7/1984 | Siegel | 175/25 |
| 4,478,295 A | | 10/1984 | Evans | |
| 4,518,048 A | | 5/1985 | Varley | |
| 4,534,427 A | | 8/1985 | Wang et al. | |
| 4,624,327 A | | 11/1986 | Reichman | |

(Continued)

OTHER PUBLICATIONS

William C. Maurer & Joe K. Heilhecker, Hydraulic Jet Drilling, Society of Petroleum Engineers of AIME, Paper No. SPE 2434, 1969, pp. 213-224.

(Continued)

*Primary Examiner*—David J Bagnell
*Assistant Examiner*—Cathleen R Hutchins
(74) *Attorney, Agent, or Firm*—Bracewell & Giuliani LLP

(57) ABSTRACT

A method and apparatus useful for fracturing subterranean formations with ultra high fluid pressure. The apparatus is capable of producing isolated pressure in a formation surrounding a primary wellbore, sufficient pressure is included within the formation for creating a fracture at the edge of the perforation. The apparatus is comprised of a motor, pump, and nozzle, where the entire apparatus can be disposed within the borehole. The apparatus can be conveyed within the borehole via wireline, coil tubing, slickline, or other tubing. Alternatively, a drill bit can be included for creating the perforation just prior to the fracturing procedure.

22 Claims, 3 Drawing Sheets

U.S. PATENT DOCUMENTS

| | | | | |
|---|---|---|---|---|
| 4,787,465 | A | 11/1988 | Dickinson, III et al. | |
| 4,887,670 | A | 12/1989 | Lord et al. | |
| 4,898,244 | A * | 2/1990 | Schneider et al. | 166/297 |
| 4,991,667 | A | 2/1991 | Wilkes, Jr. et al. | |
| 5,103,911 | A * | 4/1992 | Heijnen | 166/297 |
| 5,220,829 | A * | 6/1993 | Manke et al. | 73/152.18 |
| 5,246,080 | A | 9/1993 | Horvei et al. | |
| 5,255,750 | A | 10/1993 | Wilkes, Jr. et al. | |
| 5,402,855 | A | 4/1995 | Gondouin | |
| 5,429,036 | A * | 7/1995 | Latos | 91/181 |
| 5,429,191 | A * | 7/1995 | Schmidt et al. | 166/297 |
| 5,439,066 | A | 8/1995 | Gipson | |
| 5,553,680 | A | 9/1996 | Hathaway | |
| 5,632,604 | A | 5/1997 | Poothodiyil | |
| 5,687,806 | A | 11/1997 | Sallwasser et al. | |
| 5,699,866 | A | 12/1997 | Cousins et al. | |
| 5,765,642 | A * | 6/1998 | Surjaatmadja | 166/297 |
| 5,771,984 | A | 6/1998 | Potter et al. | |
| 5,853,056 | A | 12/1998 | Landers | |
| 5,879,057 | A | 3/1999 | Schwoebel et al. | |
| 5,894,888 | A | 4/1999 | Wiemers et al. | |
| 5,911,283 | A | 6/1999 | Cousins et al. | |
| 5,934,390 | A | 8/1999 | Uthe | |
| 5,944,123 | A | 8/1999 | Johnson | |
| 6,125,949 | A | 10/2000 | Landers | |
| 6,142,246 | A | 11/2000 | Dickinson, III et al. | |
| 6,167,968 | B1 * | 1/2001 | Allarie et al. | 166/298 |
| 6,189,629 | B1 | 2/2001 | McLeod et al. | |
| 6,206,112 | B1 | 3/2001 | Dickinson, III et al. | |
| 6,263,984 | B1 | 7/2001 | Buckman, Sr. | |
| 6,289,998 | B1 | 9/2001 | Krueger et al. | |
| 6,470,978 | B2 | 10/2002 | Trueman et al. | |
| 6,510,907 | B1 | 1/2003 | Blange | |
| 6,578,636 | B2 | 6/2003 | Mazorow et al. | |
| 6,705,398 | B2 | 3/2004 | Weng | |
| 6,920,945 | B1 * | 7/2005 | Belew et al. | 175/67 |
| 2002/0011357 | A1 | 1/2002 | Trueman et al. | |
| 2002/0062993 | A1 | 5/2002 | Billingsley | |
| 2003/0164253 | A1 | 9/2003 | Trueman et al. | |
| 2003/0213590 | A1 * | 11/2003 | Bakke et al. | 166/55.3 |
| 2003/0234106 | A1 * | 12/2003 | Surjaatmadja | 166/308 |
| 2005/0279499 | A1 | 12/2005 | Tarvin et al. | |
| 2006/0113114 | A1 * | 6/2006 | Jin et al. | 175/67 |
| 2006/0196667 | A1 * | 9/2006 | Alba et al. | 166/308.1 |

OTHER PUBLICATIONS

S.E. Forman & G.A. Secor, The Mechanics of Rock Failure Due to Water Jet Impingement, Society of Petroleum Engineers Journal, Paper No. SPE 4247, 1974, pp. 10-18.

K.K. Lafleur & A.K. Johnson, Well Stimulation in the North Sea: A Survey, Society of Petroleum Engineers of AIME, Paper No. SPE 4315, 1973, pp. 1-7.

John C. Fair, Development of High Pressure Abrasive Jet Drilling, Society of Petroleum Engineers of AIME, Paper No. SPE 8442, 1979, pp. 1-12.

Li Kexlang, Present Status and Future Trends of Jet Bit Drilling in China, Society of Petroleum Engineers, Paper No. SPE 14856, 1986, pp. 241-248 and 265-266.

Shen Zhonghou & Sun Qingxiao, A Study on the Pressure Attenuation of Submerged Non-Free Jet and a Method of Calculation for Bottom Hole Hydraulic Parameters, Society of Petroleum Engineers, Paper No. SPE 14869, 1986, pp. 521-524.

T. Butler, P. Fontana & R. Otta, A Method for Combined Jet and Mechanical Drilling, Society of Petroleum Engineers, Paper No. SPE 20460, 1990, pp. 561-565.

T-Y. Hsia & L.A. Behrmann, Perforating Skin as a Function of rock Permeability and Underbalance, Society of Petroleum Engineers, Paper No. SPE 22810, 1991, pp. 503-510.

L.A. Behrmann, J.K. Pucknell & S.R. Bishop, Effects of Underbalanace and Effective Stress on Perforation Damage in Weak Sandstone: Initial Results, Society of Petroleum Engineers, Paper No. SPE 24770, 1992, pp. 81-90.

W.J. Winters, H.B. Mount, P.J. Denitto & M.W. Dykstra, Field Tests of a Low-Cost Lateral Drilling Tool, Society of Petroleum Engineers/IADC, Paper No. SPE/IADC 25748, 1993 , pp. 1-17.

Wade Dickinson, H. Dykstra, R. Nordlund, Wayne Dickinson, Coiled-Tubing Radials Placed by Water-Jet Drilling: Field Results, Theory, and Practice, Society of Petroleum Engineers, Paper No. SPE 26348, 1993, pp. 343-355.

A.D. Peters & S.W. Henson, New Well Completion and Stimulation Techniques Using Liquid Jet Cutting Technology, Society of Petroleum Engineers, Paper No. SPE 26583, 1993, pp. 739-745.

M.A. Parker, S. Vitthal, A. Rahimi, J.M. McGowen & W.E. Martch Jr., Hydraulic Fracturing of High-Permeability Formations to Overcome Damage, Soceity of Petroleum Engineers, Paper No. SPE 27378, 1994, pp. 329-344.

S.D. Veenhuizen, T.A. O'Hanion, D.P. Kelley, J.A. Duda & J.K. Aslakson, Ultra-High Pressure Down Hole Pump for Jet-Assisted Drilling, Society of Petroleum Engineers, Paper No. IADC/SPE 35111, 1996, pp. 559-569.

S.D. Veenhuizen, J.J. Koile, C.C. Rice & T.A. O'Hanion, Ultra-High Pressure Jet Assist of Mechanical Drilling, Society of Petroleum Engineers, Paper No. SPE/IADC 37579, 1997, pp. 79-90.

S.D. Veenhuizen, DL.L. Stang, D.P. Kelley, J.R. Duda & J.K. Aslakson, Development and Testing of Downhole Pump for High-Pressure Jet-Assist Drilling, Society of Petroleum Engineers, Paper No. SPE 38581, 1997, pp. 1-8.

James S. Cobbett, Sand jet Perforating Revisited, Society of Petroleum Engineers, Paper No. SPE 39597, 1998, pp. 703-715.

P. Buset, M. Riiber & A. Eek, Jet Drilling Tool: Cost-Effective Lateral Drilling Technology for Enhanced Oil Recoverty, Society of Petroleum Engineers, Paper No. SPE 68504, 2001, pp. 1-9.

A. Gupta, D.A. Summers, & S.V. Chacko, Feasibility of Fluid-Jet Based Drilling Methods for Drilling Through Unstable Formations, Society of Petroleum Engineers, Paper No. SPE/Petroleum Society of CIM/CHOA 78951, 2002, pp. 1-6.

D.A. Summers & R.L. Henry, Water Jet Cutting of Sedimentary Rock, Journal of Petroleum Technology, Jul. 1972, pp. 797-802.

* cited by examiner

LOCALIZED FRACTURING SYSTEM AND METHOD

BACKGROUND OF THE INVENTION

1. Field of the Invention

The invention relates generally to the field of fracturing subterranean formations. More specifically, the present invention relates to a method and apparatus of fracturing subterranean formations with a self-contained system disposable within a wellbore. The present invention involves a method and apparatus for fracturing using ultra-high pressure fluids. Though the subject invention has many uses, one of its primary uses is to fracture a subterranean formation within a well for stimulation of production in that well.

2. Description of Related Art

Stimulating the production of hydrocarbons from within hydrocarbon bearing subterranean formations is often accomplished by fracturing portions of the formation to increase fluid flow from the formation into a wellbore. Fracturing the formation, a process also known as fracing, typically involves sealing off or isolating a portion of the wellbore from the surface and pressurizing the fluid within the isolated portion of the wellbore to some pressure that in turn produces a fracture in the formation. The fluid being pressurized can be a drilling fluid, but can also be a fracturing fluid specially developed for fracturing operations. Examples of fracturing fluids include gelled aqueous fluids that may or may not have suspended solids, such as proppants, included within the fluid. Also, acidic solutions can be introduced into the wellbore prior to, concurrent with, or after fracturing. The acidic solutions can etch out fracture faces on the inner circumference of the wellbore that help to help create and sustain flow channels within the wellbore for increasing the flow of hydrocarbons from the formation.

The isolation of the wellbore prior to fracturing is performed either when using a gelled fluid as well as an acidic solution. Isolating the wellbore can be accomplished by strategically inserting a packer within the wellbore for sealing the region where the fluid is to be pressurized. Optionally, in some formations, a high-pressure fluid can be pumped into the wellbore thereby pressurizing the entire wellbore without isolating a specific depth within the wellbore for fracing. Examples of these methods can be found in the following references: U.S. Pat. No. 6,705,398, U.S. Pat. No. 4,887,670, and U.S. Pat. No. 5,894,888.

However one of the drawbacks of the presently known systems is that the fluid is dynamically pressurized by devices that are situated above the wellbore entrance. This requires some means of conveying the pressurized fluid from the pressure source to the region within the wellbore where the fluid is being delivered. Often these means include tubing, casing, or piping through which the pressurized fluid is transported. Due to the substantial distances involved in transporting this pressurized fluid, large pressure drops can be incurred within the conveying means. Furthermore, there is a significant capital cost involved in installing such a conveying system. Accordingly there exists a need for a fracturing system capable of directing pressurized fluid to an isolated zone within a wellbore, without the pressure losses suffered by currently known techniques.

BRIEF SUMMARY OF THE INVENTION

One embodiment of the present invention includes a method of fracturing a subterranean formation, where the method comprises, deploying a fluid pressurizing system within a wellbore, pressurizing fluid with the fluid pumping system to create pressurized fluid within a zone of the wellbore. Where the pressurized fluid is pressurized to a pressure sufficient to create a fracture within the subterranean wellbore. The method includes directing the pressurized fluid at a portion of the subterranean formation. The zone of the wellbore can be within a lateral wellbore. The method of the present invention can further comprise creating a pressure seal around the zone within the wellbore, wherein creating the pressure seal comprises setting a packer. Optionally, the pressurized fluid can be pressurized to an ultra high pressure.

The method of the present invention can further comprise creating the fluid pumping system by connecting a motor to a pump unit and providing an articulated arm in fluid communication with the pump unit. Additionally, the pump unit can be actuated with the motor, thereby producing the pressurized fluid with the pump unit, and directing the pressurized fluid from the pump unit to the articulated arm. Preferably a nozzle can be included that is in fluid communication with the articulated arm adapted to form a pressurized fluid jet with the fluid received from the articulated arm. The method can yet further include inserting the arm into a lateral well section and directing the fluid jet exiting the nozzle within the lateral section. The method of the present invention can also include creating a pressure seal around the zone within the lateral wellbore as well as anchoring the fluid pumping system within the wellbore.

Optionally, the method of the present invention can include storing pressurized fluid within an accumulator and instantaneously releasing substantially all of the pressurized fluid from the accumulator into the wellbore. The instantaneous release of the pressurized fluid from the accumulator imparts a shock wave within the wellbore capable of having a rubbleizing effect within the wellbore and thereby creating fractures into the formation adjacent the wellbore.

The present invention can include a well fracturing system comprising a pressure source disposable within a wellbore capable of pressurizing fluid in a zone of the wellbore to a pressure sufficient to fracture a subterranean formation. The apparatus further includes a nozzle having an inlet in fluid communication with the pressure source and an outlet open to the wellbore and a motor connected to the pressure source capable of driving the pressure source. The well fracturing system can further comprise an arm on which the nozzle is provided and at least one conduit capable of providing fluid communication between the pressure source and the arm. The arm can be articulated and be extendable from within the housing and into subterranean formation lateral to the wellbore.

The motor of the well fracturing system is preferably disposed proximate to the pressure source and can be an electric motor or a mud motor. The pressure source can be a pump unit and can be a crankshaft pump, a wobble pump, a swashplate pump, an intensifier, or combinations thereof. The pressure source of the present invention can be capable of pressurizing fluid from about 1400 kilograms per square centimeter to at least about 3515 kilograms per square centimeter, alternatively, the pressure source can pressurize fluid to at least 3515 kilograms per square centimeter.

DETAILED DESCRIPTION OF THE INVENTION

Figure 1:
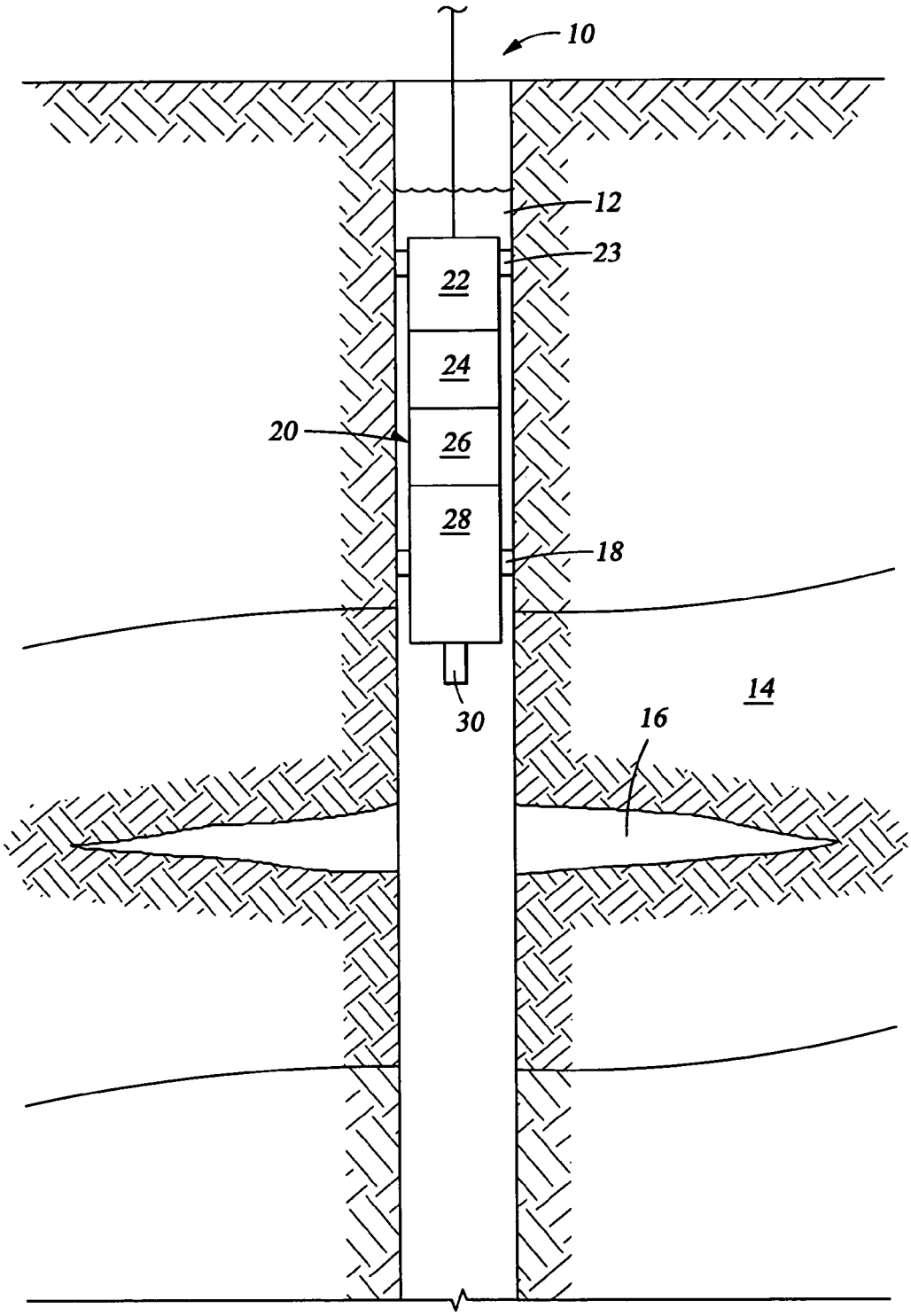
FIG. 1 depicts a sideview of an embodiment of the invention within a wellbore.

FIG. 1 illustrates an embodiment of a fracing system 20 of the present invention disposed within a wellbore 10. As shown, the wellbore 10 extends through a subterranean formation 14 from which it is desired to extract hydrocarbons. One use of the present invention includes stimulation of hydrocarbon production from the subterranean formation 14 by creating fractures 16 through the subterranean formation 14. Implementation of the present invention into a wellbore 10 increases the pressure of the fluid 12 within the wellbore 10 to an amount sufficient to fracture the subterranean formation 14. Generally the fractures 16 extend into the subterranean formation 14 in a direction that is lateral or perpendicular to the direction of the wellbore 10.

The fracing system 20 of FIG. 1 comprises a motor 24 connected to a pump unit 26 set atop a lower housing 28. Preferably the motor 24 is an electric motor driven by an electrical source (not shown) located at the surface above the wellbore 10. The electrical source could also be situated at a site within the wellbore 10, such as proximate to the motor 24. Alternatively, the electrical source could comprise a battery combined with or adjacent to the motor 24. Types of motors other than electrical, such as a mud motor, can be employed with the present invention. Optionally, the motor 24 could be placed above the surface of the wellbore 10 and connected to the pump unit 26 via a crankshaft (not shown). It is well within the capabilities of those skilled in the art to select, design, and implement types of motors that are suitable for use with the present invention. The present invention can also include an anchoring device 22 with associated slips 23 for securing the fracing system 20 within the wellbore 10 during use.

The fracing system 20 is operable downhole and can be partially or wholly submerged within the fluid 12 of the wellbore 10. The fluid 12 can be any type of liquid, including water, brine, diesel, alcohol, guar based fracturing fluids, cellulosic polymeric compounds, gels, and the like. In one embodiment, the fluid 12 is the fluid that already exists within the wellbore 10 prior to the operation. Additionally, the fluid 12 can contain a proppant material such as sand and/or silica compounds to aid in the fracturing process.

As previously noted, the fracing system 20 can be at least partially submerged within wellbore fluid 12. While in use it is important that the suction side of the pump unit 26 be in fluid communication with the wellbore fluid 12. During operation, the pump unit 26 receives the wellbore fluid 12 through its suction side, pressurizes the fluid, and discharges the pressurized fluid from its discharge side. While the discharge pressure of the pump unit 26 can vary depending on the particular application, it should be capable of producing ultra high pressures. In the context of this disclosure, ultra high pressures are pressures that exceed 20,000 pounds per square inch (1400 kg/cm$^2$). However, the fracing system 20 of the present invention may be capable of pressurizing fluids to pressures in excess of 50,000 pounds per square inch (3515 kg/cm$^2$). The pump unit 26 can be comprised of a single fluid pressurizing device or a combination of different fluid pressurizing devices. The fluid pressurizing units that may comprise the pump unit 26 include, an intensifier, centrifugal pumps, swashplate pumps, wobble pumps, crankshaft pumps, and combinations thereof.

In the embodiment of FIG. 1, the pressurized fluid discharged from the pump unit 26 exits the fracing system 20 via a fluid exit 30. Prior to initiating the pump unit 26, a packer 18 is installed in the annulus between the fracing system 20 and the inner diameter of the wellbore 10. Adding the packer 18 around the fracing system 20 provides a pressure barrier within the wellbore 10 separating the wellbore fluid 12 above the packer 18 from the wellbore fluid 12 below the packer 18. Thus pressurizing the region of the wellbore 10 below the packer 18 should not alter the pressure of the wellbore fluid 12 above the packer 18. Accordingly operation of the embodiment of FIG. 1 involves setting the packer 18 then operating the pump unit 26 in order to pressurize the region of the wellbore 10 below the packer 18. When the pressure within this region exceeds the fracturing pressure, fractures 16 can be created adjacent the wellbore 10 that extend into the subterranean formation 14 thereby enhancing hydrocarbon production from the subterranean formation 14 into the wellbore 10.

Figure 2:
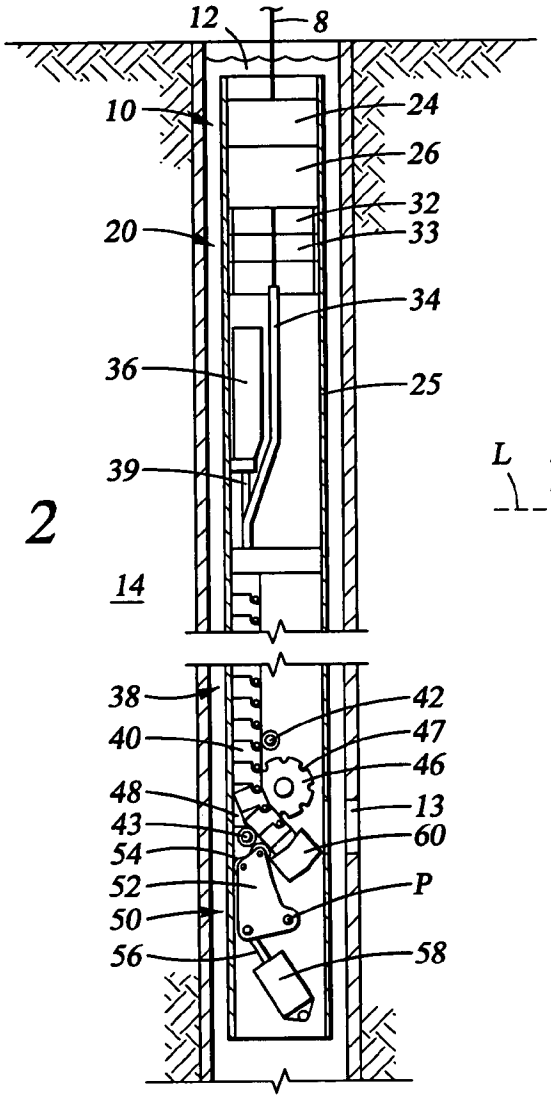
FIG. 2 illustrates a partial cutaway view of an embodiment of the invention in a retracted position.
Figure 4:
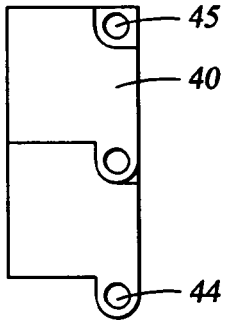
FIG. 4 shows a side view of arm segments used in an embodiment of the invention.
Figure 5:
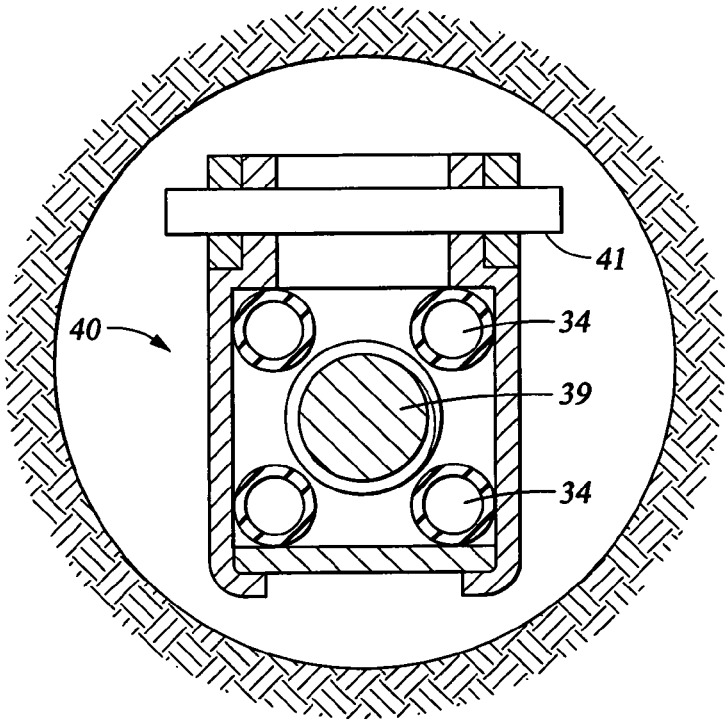
FIG. 5 depicts a cross sectional view of an arm used in an embodiment of the invention.

With reference now to FIG. 2, an alternative embodiment of the fracing system 20 includes an arm 38 included that is in fluid communication with the discharge side of the pump unit 26. Fluid hoses 34 extending from the discharge side of the pump unit 26 provide the fluid communication to the arm 38. Optionally, an intensifier 32 can be included with the fracing system 20 on the discharge side of the pump unit 26. As seen in FIGS. 2 through 5, the arm 38 is comprised of a series of generally rectangular segments 40, where each segment 40 includes a tab 44. More preferably each segment 40 includes a pair of tabs 44 disposed on opposite and corresponding sides of the individual segment 40 extending outward from the rectangular portion of the segment 40 and overlapping a portion of the adjoining segment 40. An aperture 45 capable of receiving a pin 41 is formed through each tab 44 and the portion of the segment 40 that the tab 44 overlaps. Positioning the pin 41 through the aperture 45 secures the tab 44 to the overlapped portion of the adjoining segment 40 and pivotally connects the adjacent segments 40. Strategically positioning the tabs 44 and apertures 45 on the same side of the arm 38 results in an articulated arm 38 that can be flexed by pivoting the individual segments 40.

Figure 3:
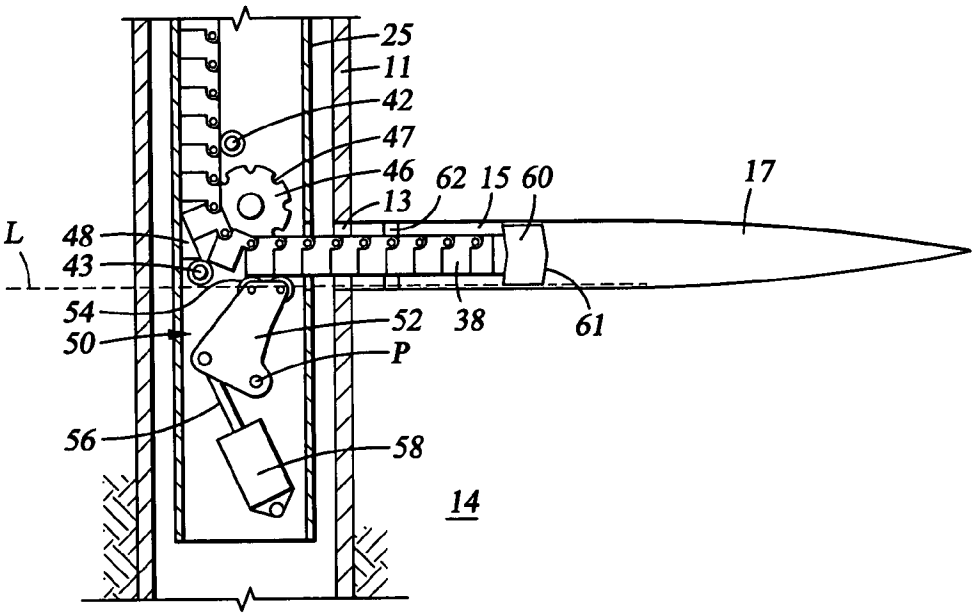
FIG. 3 portrays a partial cutaway view of an embodiment of the invention in an extended position.

The fracing system 20 is suspended within the wellbore 10 via a wireline 8 to the location where the subterranean fracturing operation is to be conducted. In the context of this application, the wireline 8, a slickline, coil tubing and any other method of conveyance down a wellbore can be considered for use with embodiments of the present invention. Properly positioning the fracing system 20 at the desired location within the wellbore 10 is well within the capabilities of those skilled in the art. With reference now to FIGS. 2 and 3, the arm 38 of FIG. 2 is in the stored or retracted position. In contrast the arm 38 as shown in FIG. 3 is in the extended or operational position. In moving from the stored into the extended position the arm 38 passes through a gap 13 formed in the casing 11 that lines the wellbore 10 and into a perforation 15 disposed lateral to the wellbore 10. The perforation 15 can also be referred to as a lateral wellbore. Typically the gap 13 and the perforation 15 are formed at the same time and can be produced by a shaped charge used in a perforating operation. Optionally, the tip of the arm 38 can be fitted with a drill bit 60 that when rotated is capable of drilling through the casing 11 and into the formation 14, thereby forming the gap 13 and the perforation 15.

Launching the arm 38 into the operational mode involves directing or aiming the tip of the arm 38 towards a portion of the subterranean formation 14 where the perforation 15 is to be formed. A launch mechanism 50 is used to position and aim the arm 38 into the gap 13 and perforation 15. Furthermore, the launch mechanism 50 can also aim and position the arm 38 to perforate the casing 11 and formation 14 if the gap 13 and perforation 15 are created with the optional drill bit 60. The launch mechanism 50 comprises a base 52 pivotally connected to an actuator 58 by a shaft 56 and also pivotally connected within the housing 25 at pivot point P. Rollers 54 are provided on adjacent corners of the base 52 such that when the arm 38 is in the retracted position a single roller 54 is in contact with the arm 38. Extension of the shaft 56 outward from the actuator 58 pivots the base 52 about pivot point P and puts each roller 54 of the launch mechanism 50 in supporting contact with the arm 38. The presence of the rollers 54 against the arm 38 support and aim the arm 38 so that it is substantially aligned in the same direction of a line L connecting the rollers 54. It will be appreciated by those skilled in the art that by adjusting the pivot of the base 52 around its pivot point P, the associated line L can be adjusted accordingly. This ability of adjusting the angle of the line L thereby provides an unlimited number of options for pointing the arm 38 into the formation 14 with correspondingly unlimited angled perforations 15 and fractures 17.

Although the embodiment of the invention of FIG. 3 illustrates an arm 38 that is positioned substantially horizontal, the arm 38 can be situated at any angle lateral to the wellbore 10 based on the desired angle or the particular application. As will be appreciated by those skilled in the art, the direction of the arm 38 extending from the housing 25 can be adjusted by the changing the pivot of the base 52 about the pivot point P. A gear 46 with detents 47 on its outer radius and idler pulleys (42 and 43) is provided to help guide the arm 38 as it is being retracted and extended. The detents 47 receive the pins 41 disposed on each segment 40 and help to track the arm 38 in and out of its respective retraction/extension positions. The idler pulleys (42 and 43) ease the directional transition of the arm 38 from a substantially vertical position to a substantially lateral position as the segments 40 pass by the gear 46.

While aiming or directing the arm 38 is accomplished by use of the launch mechanism 50, extending the arm 38 from within the housing 25 is performed by a drive shaft 39 (FIG. 5) disposed within the arm 38. The drive shaft 39 is connected on one end to an arm actuator 36 and on its other end to the free end of the arm 38. The arm actuator 36 can impart a translational downward force onto the drive shaft 39 that in turn can urge the free end of the arm 38 through the gap 13 and into the perforation 15. Optionally, when the drill bit 60 is included on the free end of the arm 38, the arm actuator 36 can also provide a rotating force onto the drive shaft 39 that is transferred by the drive shaft 39 to the drill bit 60. Since the drive shaft 39 is disposed within the arm 38, it must be sufficiently flexible to bend and accommodate the changing configuration of the arm 38. Although flexible, the drive shaft 39 must also possess sufficient stiffness in order to properly transfer the rotational force from the arm actuator 36 to the drill bit 60.

In operation of the embodiment of the fracing system 20 of FIGS. 2 and 3, the arm 38 is transferred from the retracted into an extended position by actuation of the launch mechanism 50 and extension of the drive shaft 39 by the arm actuator 36. Once the arm 38 is aligned with the gap 13 the arm actuator 36 can force the drive shaft 39 downward thereby urging the free end of the arm 38 into the perforation 15. Following the insertion of the arm 38 into the perforation 15, a packer 62 can then be positioned around the body of the arm 38 in order to provide a pressure seal between the perforation 15 and the primary wellbore 10. As soon as the packer 62 is firmly in place around the arm 38, the motor 24 can be actuated to drive the pump unit 26 thereby supplying pressurized fluid into the perforation 15. Continued fluid flow into the perforation 15 can increase the fluid pressure within the perforation 15 until the pressure required for inducing a fracture within the formation 14 is reached thereby producing a fracture 17 that extends outward from the perforation 15. As previously noted, the present invention is capable of producing a large range of fluid pressures; this is especially advantageous in situations where the magnitude of the pressure to fracture some formations may be substantially larger than in other formations.

Fracturing with the embodiment of FIGS. 2 and 3 having the optional drill bit 60 is similar to the embodiment without the drill bit 60, except when the drill bit 60 is included it can be used to create the gap 13 and the perforation 15. As previously discussed, the drill bit 60 can be actuated by rotating the drive shaft 39 with the arm actuator 36. Thus simultaneous drive shaft 39 rotation, along with translational urging of the drive shaft 39, pushes the rotating drill bit 60 through the casing 11 and into the formation 14, thereby forming the gap 13 and perforation 15. To further enhance the drilling capabilities of the drill bit 60, especially when drilling the perforation 15, the pressurized fluid from the pump unit 26 can be discharged from nozzles 61 located on the face of the drill bit 60. After the perforating operation is complete, the packer 62 can be set and the fracture 17 can be produced in the same manner as the fracing system 20 without the drill bit 60.

Figure 6:
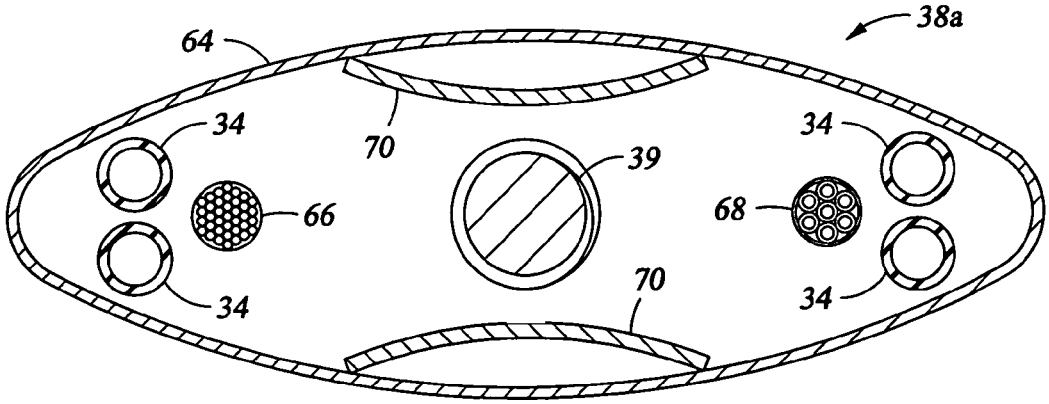
FIG. 6 illustrates a cross sectional view of an embodiment of an arm for use with the present invention.

FIG. 6 portrays a cross sectional view of an alternative embodiment of an arm **38*a*. The components of the arm 38*a* are housed within a sheath 64 that is rigid enough to maintain the components in place within the sheath 64, yet sufficiently bendable for deployment from the fracing system 20 into the surrounding formation 14. Included with the arm 38*a* are fluid hoses 34, a cable 66, a telemetry line 68, a drive shaft 39*a*, and at least one shaping member 70. The sheath 64 can be made of a resilient cover, such as a polymer or polymer type material, fitted over a frame. The cover should be resistant to the harsh elements typically found within a wellbore 10, such as sulfuric compounds, acids, and other corrosive substances. The frame can be comprised of a metal such as steel and formed into a spring like spiral or chain like mail. Thus the combination of the frame to secure the components of the arm 38*a* along with the ability to shield against harmful compounds provided by the cover protects the arm 38*a* components against corrosion or other like effects. The drive shaft 39*a* provides rotational force for an optional drill bit (not shown) mountable on the free end of the arm 38*a*. The cable 66 exerts a pushing or pulling force onto the arm 38*a* thereby extending or retracting the arm 38*a* from or into the fracing system 20. The at least one shaping member 70 is generally elongated and extends substantially along the length of the arm 38*a*. The shaping member 70 is curved with respect to its axis that increases its rigidity, thereby increasing the overall rigidity of the arm 38*a*. Preferably the shaping member(s) 70 is (are) comprised of spring steel. It is desired to maintain a certain amount of rigidity in the arm 38*a* so that it can be used with the launch mechanism 50 of FIGS. 2 and 3 or some other suitable deploying mechanism. The telemetry line 68 provides for the conveyance of telemetry data from data collection devices (not shown) within the wellbore 10** to the surface for data collection and subsequent analysis.

In some instances the formation 14 may have adequate porosity to absorb the entire volume of the pressurized fluid delivered by the fracing system 20. Thus the potential energy within the pressurized fluid is converted into kinetic energy that drives the pressurized fluid into the formation 14 instead of creating an additional fracture (16, 17) within the wellbore 10. To overcome such a setback, one embodiment of the present invention provides an accumulator 33 for storing fluid after it has been pressurized by the pump unit 26 and/or the intensifier 32. In this embodiment, as shown in FIG. 2, the fluid being pressurized by the pump unit 26 and/or intensifier 32 is directed to the accumulator 33. The fluid within the accumulator 33 is stored at a pressure substantially equal to the discharge pressure of the pump unit 26 and/or intensifier 32. Once the accumulator 33 contains a certain amount of pressurized fluid, or the fluid pressure within the accumulator 33 reaches a certain value, the pressurized fluid within the accumulator 33 can be instantaneously discharged from the fracing system 20 through the nozzles 61 via the fluid hoses 34. The discharge of the pressurized fluid from the accumulator 33 can be performed by implementing a remotely operated valve between the accumulator 33 and the fluid hoses 34.

The instantaneous discharge of the pressurized fluid from the fracing system 20 imparts a shock wave into the wellbore 10 that is not absorbed within the formation 14 but instead creates fractures (16, 17) within the wellbore 10. This process of instantaneous delivery of a high pressure fluid to the wellbore 10 is also known as rubbleization. Furthermore, the shock waves can be delivered multiple times by repeatedly sealing and then opening the discharge side of the accumulator 33. It is believed that it is well within the capabilities of those skilled in the art to ascertain the proper size of the accumulator 33 and an appropriate system for the discharge of fluid from the accumulator 33.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of introducing a fluid into a subterranean formation comprising:

deploying a pressurizing system within a wellbore on a wireline, wherein the pressurizing system comprises a housing, motor in the housing, a pump in the housing and coupled to the motor;

sealing a region of the wellbore;

driving the pump by actuating the motor;

pressurizing wellbore fluid within the wellbore with the pump;

discharging the pressurized fluid into the sealed region of the wellbore; and pressurizing the sealed region of the wellbore with the discharge of pressurized fluid to fracture the subterranean formation.

2. The method of claim 1, wherein the pump pressurizes the fluid to at least about 1400 kilograms per square centimeter.

3. The method of claim 1, wherein the pump pressurizes the fluid to at least about 3515 kilograms per square centimeter.

4. The method of claim 1 wherein said pressurizing system further comprises an articulated arm in fluid communication with said pump, the articulated arm selectively extendable from within the housing.

5. The method of claim 4 further comprising actuating said pump with said motor, producing said pressurized fluid with said pump, and directing said pressurized fluid from said pump to said articulated arm.

6. The method of claim 5 further comprising forming a nozzle in fluid communication with said articulated arm adapted to form a pressurized fluid jet with the fluid received from said articulated arm.

7. The method of claim 6 further comprising inserting said arm into a lateral well section and directing said fluid jet exiting said nozzle within the lateral section.

8. The method of claim 1 wherein said zone is within a lateral wellbore.

9. The method of claim 1 further comprising anchoring said fluid pumping system within said wellbore.

10. The method of claim 1 wherein said zone is within a vertical wellbore.

11. A well fracturing system comprising:

a housing disposable in the well;

a wireline attached to the housing;

a seal selectively set between the housing and the well, so that when the seal is set a sealed region is defined in the well;

an electric motor in the housing; and a pump connected to the motor, the pump comprising;

an inlet in fluid communication with wellbore fluid in the well; and a discharge in fluid communication with the sealed region and at a pressure at least as great as the pressure for fracturing a subterranean formation.

12. The well fracturing system of claim 11, further comprising an arm extendable from the system and into subterranean formation lateral to the wellbore and a nozzle in the arm having an inlet in fluid communication with said pressure source.

13. The well fracturing system of claim 11, further comprising an intensifier.

14. The well fracturing system of claim 11, wherein the pump discharge pressure is at least about 1400 kilograms per square centimeter to at least about 3515 kilograms per square centimeter.

15. The well fracturing system of claim 11, wherein the pump discharge pressure is at least about 3515 kilograms per square centimeter.

16. The well fracturing system of claim 11 further comprising an accumulator in fluid communication with the pump discharge.

17. A method of creating a fracture within a wellbore comprising:

(a) providing a fracturing system comprising, a housing, an electric motor in the housing, a pump in the housing and coupled to the motor, a fluid inlet and outlet on the pump;

(b) disposing the fracturing system within the wellbore on a wireline;

(c) pressurizing fluid in the wellbore by driving the pump with the motor, receiving fluid in the wellbore at the pump inlet, pressurizing the fluid to a pressure sufficient to fracture a subterranean formation, and discharging pressurized fluid from the pump outlet;

(d) storing said pressurized fluid in an accumulator;

(e) discharging said stored pressurized fluid from the accumulator into the wellbore; and (f) fracturing a formation adjacent the wellbore with the pressurized fluid.

18. The method of claim 17 further comprising repeating steps (c)-(f).

19. The method of claim 17, wherein said fracturing system further comprises an articulated arm in fluid communication with said accumulator.

20. The method of claim 17, further comprising pressurizing said fluid to an ultrahigh pressure.

21. The method of claim 17 further comprising pressurizing fluid with said fluid pressurizing system to a pressure from about 1400 kilograms per square centimeter to at least about 3515 kilograms per square centimeter.

22. The method of claim 17 further comprising pressurizing fluid with said fluid pressurizing system to a pressure of at least about 3515 kilograms per square centimeter.

* * * * *